United States Patent [19]

Aghnides

[11] Patent Number: 4,534,513

[45] Date of Patent: Aug. 13, 1985

[54] CONCEALED AERATOR

[76] Inventor: Elie P. Aghnides, Hotel Pierre, 795 Fifth Ave., New York, N.Y. 10021

[21] Appl. No.: 457,775

[22] Filed: Jan. 13, 1983

[51] Int. Cl.[3] ..... E03C 1/084

[52] U.S. Cl. ..... 239/428.5

[58] Field of Search ..... 239/288–288.5, 239/428.5, DIG. 18; 261/DIG. 22

[56] References Cited

U.S. PATENT DOCUMENTS

| | | | |
|---|---|---|---|
| Re. 25,447 | 9/1963 | Hjulian . | |
| 3,014,667 | 12/1961 | McLean et al. . | |
| 3,067,951 | 12/1962 | Aghnides . | |
| 3,270,965 | 9/1966 | Aghnides . | |
| 3,279,702 | 10/1966 | Aghnides . | |
| 3,298,614 | 1/1967 | Aghnides . | |
| 3,363,841 | 1/1968 | Aghnides . | |
| 3,635,405 | 1/1972 | Shames et al. | 239/428.5 |
| 3,827,636 | 8/1974 | Parkison et al. | 239/428.5 |

FOREIGN PATENT DOCUMENTS

| | | |
|---|---|---|
| 428595 | 9/1966 | Switzerland . |
| 986142 | 3/1965 | United Kingdom . |
| 1189550 | 4/1970 | United Kingdom . |

*Primary Examiner*—Andres Kashnikow

*Attorney, Agent, or Firm*—William D. Hall

[57] ABSTRACT

An aerator (208) for introducing air into a liquid flowing under pressure through a spout (200), the aerator (208) being partially or totally concealed by the spout (200) and being substitutable—in dimensions and flow characteristics—with a conventional, unconcealed aerator having standard male threading. The concealed aerator (208) is couplable to a spout (200) having female threading at the most downstream portion (202) thereof and provides enhanced sealing (218) between the concealed aerator (208) and spout (200).

38 Claims, 12 Drawing Figures

CONCEALED AERATOR

RELATED CASES

This is a continuation-in-part of PCT application Serial Number PCT/US-81-01341 filed on Oct. 2, 1981, now WO 83/01266, and entitled Concealed Liquid Flow Aerator invented by Elie P. Aghnides.

DESCRIPTION

1. Technical Field

The present invention relates to aerators insertable into a female threaded spout.

2. Background Art

In the past, aerators that are insertable into the end of a spout through which liquid under pressure flows have been designed in various ways to be concealed within the spout. The present inventor has, in fact, taught numerous concealed aerators in certain of his foreign and United States patents.

In United Kingdom Pat. No. 1,189,550, FIGS. 4 through 7 illustrate concealed aerators. In each depicted embodiment in the UK patent, the aerator is threaded at its upstream end and does not show a spout which is female threaded at the most downstream portion. A large portion of commercial aerators are not concealed and are coupled to the female threading of a spout at the most downstream portion thereof. Accordingly, the aerators shown in UK Pat. No. 1,189,550 have not been substitutable with a number of commercial aerators of the unconcealed variety. In addition, the outer diameters of the aerators of the prior British patent were not specified as having *standard* male threads, corresponding to those of common conventional unconcealed aerators, thus further underscoring the lack of substitutability of the concealed aerators and known unconcealed aerators. Further, the British patent does not teach the extending of the aerator upstream from the threading and, hence, does not teach an upstream portion of smaller diameter than the threaded downstream portion of the aerator. Thus, although useful and valuable in its intended illustrated embodiments, the invention pictured in UK Pat. No. 1,189,550 lacked substitutability in various instances.

In U.S. Pat. No. 3,067,951 an at least partly concealed Aghnides aerator is disclosed. As in the British patent, this U.S. Patent does not teach an unthreaded upstream extension. The entire length of the concealed portion of this prior aerator is threaded and coupled to the length of female threading in the spout. Like UK Pat. No. 1,189,550, this patented embodiment does not house any portion of the aerator above the threaded portion of the aerator and is, to that extent, limited in application.

U.S. Pat. No. 3,298,614, also to Aghnides, shows a concealed aerator in FIG. 5 which does extend upward into the spout beyond the threading. However, this embodiment relies on only the threading to achieve sealing and does not show the aerator of FIG. 5 inserted into a spout having a smaller inner diameter upstream from the threaded spout end.

It is noted that the UK Pat. No. 1,189,550 teaches an annular shoulder (28) of transverse wall (13) which abuts the spout (25). In Aghnides '951 a perforated disc (61) abuts the spout (60). However, in both instances the internal structure of the aerator contacts the spout. Pressure is thus applied to the transverse wall or disc upon insertion of the aerator.

Finally, U.S. Pat. No. 3,014,667 to McLean et al. illustrates in FIG. 9 a flow control device in an aerator. The McLean device does not teach an aerator insertable into a spout threaded at its most downstream end. The McLean et al. device also clusters the aerator (82) downstream from the threads, while a flow control element (84) is coupled to the aerator and placed upstream of the threads. McLean et al. do not disclose how to extend an aerator upward into a smaller diameter portion of a spout in order to achieve concealment thereof, or to increase flow length in the aerator, when the aerator is coupled to threads at the most downstream portion of the spout. Accordingly, substitutability with standard threaded, unconcealed aerators is not sought. That is, as with other prior concealable aerators, the McLean et al. device does not indicate that its male threading conforms to the standard threading of unconcealed aerators.

In reviewing the above references, it is thus noted that the prior patents (a) do not feature aerator substitutability in size and (b) do not provide sealing by an element carried on an annular ledge formed by the interfacing of the upstream portion and threaded downstream portion of an aerator—the downstream portion having a larger outer diameter.

It is also noted that the prior references do not provide the structure or dimensions of elements for a concealed aerator which would yield the same flow characteristics of a conventional unconcealed aerator. This is, of course, significant where various governments have provided regulations controlling flow characteristics. McLean et al. employ a separate flow control element, but do not discuss how to define substitutable flow characteristics with the aerator alone. None of the references specify the relative dimensions of the spout and aerator required for such substitutable flow and none provide for a jet forming element with longitudinal channels therethrough where the channels discretely increase in cross-section downstream in order to achieve conventional flow characteristics.

Further, the references which do not extend the aerator length also do not allow for a screen in the aerator to be displaced longitudinally upward and downward when a coin—used for screwing and unscrewing the aerator—is inserted into the lower end of the aerator.

DISCLOSURE OF INVENTION

The present invention is directed to a partially or fully concealed aerator which is screwably attachable to female threading at the most downstream portion of a spout. Through the spout fluid to be aerated flows under pressure. According to the invention, the female threading is a standard threading which corresponds to conventional, unconcealed aerators. Upstream from the female threading of the spout is an upstream pipe portion of smaller inner diameter than the female threaded downstream pipe portion of the spout. The present aerator is dimensioned to fit in such a spout, the aerator having standard male threading and having a reduced diameter upstream therefrom. It is thus an object of the invention to provide a concealed aerator which fits into a spout which can also accomodate a standard, unconcealed aerator.

In addition, it is an object of the invention to enhance sealing of the substitutable concealed aerator against the spout by defining an annular ledge interfacing between the upstream portion and downstream threaded portion of the aerator and including an annular sealing element on the ledge. Inasmuch as in the United States and abroad the threading of most existing and new faucets is at present standard female threads having an inner diameter of 23.00 mm. (13/16/27 TPI), an object of the invention is the creation of an aerator having male threads which will fit said standard female threads and which is partially or entirely concealable, to permit easy replacement of old aerators and to avoid any changes with regard to said female threads and to the dimensions upstream said threads in the manufacture of new faucet spouts.

In aerators entirely concealed, it is also an object of the invention to provide effective means for screwing the aerator to and from the spout. Indents are provided at the bottom of the aerator into which a coin is insertable. When inserted, the coin enters a longitudinal cavity within the aerator. A screen contained in a shell is either (a) pushed upward in the cavity by the coin during insertion thereof, the screen returning to a lower position when the coin is removed, or (b) fixedly coupled far enough upstream in the cavity so that the coin is insertable without contacting the shell containing the screen. In the first instance, means are provided for limiting the downstream travel of the shell.

In one embodiment, the invention is a totally concealed aerator. In another embodiment, a "partially" concealed aerator is provided. In this invention, "partially" concealed means that the aerator includes (a) a male threaded portion which is screwable into female threading at the most downstream pipe portion of a spout, (b) an unthreaded portion upstream from the male threaded portion, and (c) an unthreaded portion downstream from the male threaded portion, wherein only the unthreaded downstream portion is not concealed.

To further facilitate fabrication, assembly, and installation and to decrease cost, the aerator is formed of molded plastic—various portions of the aerator being combined into an integral structure. Also, in a specific embodiment, the plastic may include metal therein if desired.

Further, in a specific embodiment of a partially concealed aerator, the unthreaded downstream portion is contained within a metal sleeve or housing which, to cover a conventional aerator, would have to be twice as big and cost correspondingly more. Also in the partially concealed aerator form of the invention, it is preferred that the inner diameter of the portion of the aerator downstream from the threading exceed the inner diameter of the portion upstream from the threading. This achieves the object of enhanced flow characteristics.

BRIEF DESCRIPTION OF THE DRAWINGS

In FIG. 1 an annular sealing washer is provided between the aerator and the spout; FIG. 4 illustrates an alternative in which an annular ridge extending upward from the aerator provides a sealing function in addition to the sealing effected by the coupled threading.

BEST MODE FOR CARRYING OUT THE INVENTION

Figure 1:
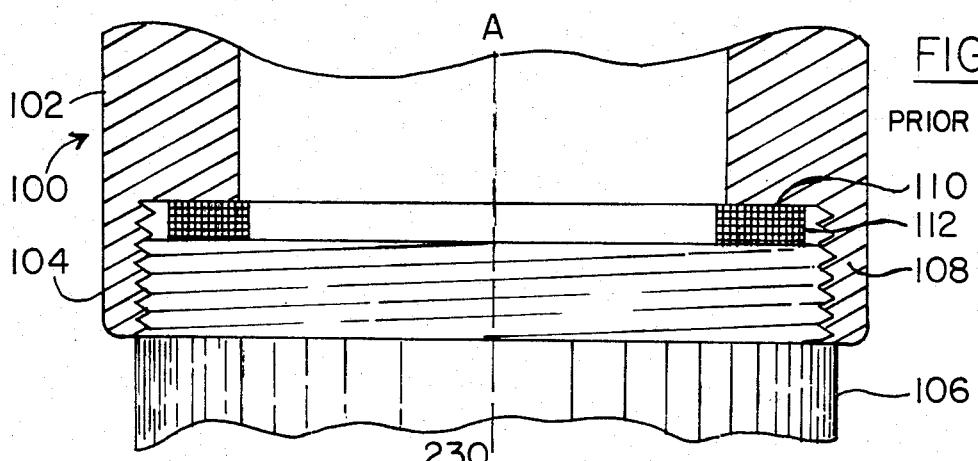
FIG. 1 PRIOR ART
FIG. 1 is an illustration of a prior art unconcealed aerator which is inserted in a spout of a given diameter.

Referring to FIG. 1, a spout (100) is shown having an upstream portion (102) and a female threaded downstream pipe portion (104). The female threaded portion (104) has a standard female threading of approximately 23.5 mm. Shown inserted into the most downstream portion of (104) is a conventional, unconcealed aerator (106) having a standard male threading (108) which is complementary with the female threading at the spout end. That is, the male threading (108) has an outer diameter of approximately 23.5 mm. Examining the upstream pipe portion (102) of the spout (100), it is noted that the inner diameter thereof is significantly less than the inner diameter of the female threading provided along the inner surface of the downstream pipe portion (104). In this regard, it is noted that an annular surface (110), which is transverse to the longitudinal axis A of the spout (100), is defined along the inner contour of the spout (100). To provide sealing of the conventional, unconcealed aerator (106), an annular washer (112) is provided. Hence, the annular washer (112) provides one measure of sealing and the threading provides a second measure of sealing.

Figure 2:
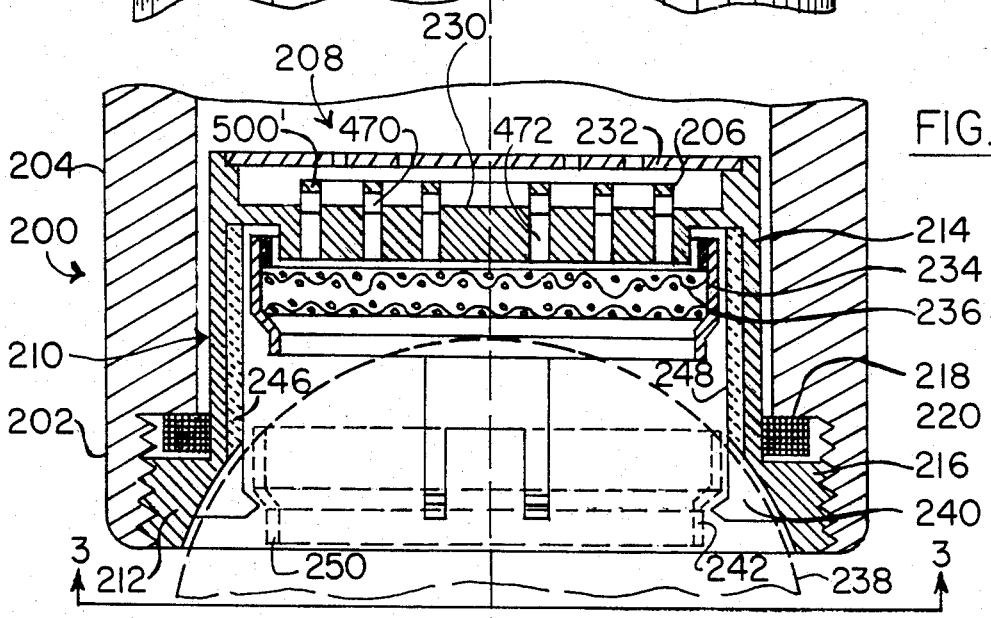
FIG. 2 is an illustration of a fully concealed aerator which is insertable into a spout having standard female threading at its most downstream portion.

Referring now to FIG. 2, a spout (200) is illustrated. The female threading at the most downstream portion (202) is the same as that shown in FIG. 1. However, it is noted that the inner diameter of the upstream portion (204) is increased relative to the inner diameter of the spout shown in FIG. 1. This permits a greater inflow of water to an inlet element (206) at the upstream entrance to a totally concealed aerator (208). As will be noted below, the dimensions of the concealed aerator (208) shown in FIG. 2 are significant in that they permit the concealed aerator (208) to not only fit within the standard female threading at the end of a spout, but also to achieve flow characteristics for the concealed aerator (208) comparable to the flow from the conventional, standard unconcealed aerator (106) shown in FIG. 1.

The totally concealed aerator (208) of FIG. 2 includes a tubular element (210) which extends the length of the concealed aerator (208). The tubular element (210) includes a first tubular length (212) which has standard male threading which is complementary with the threading at the spout end. The tubular element (210) also includes a second tubular length (214), which is unthreaded and extends upstream of the threaded portion (202). The second tubular length (214) has an outer diameter which is less than the outer diameter of the threads of the first tubular length (212). Interfacing and extending between the outer surface of the first tubular length (212) and the second tubular length (214) is an annular ledge (216). Due to the aerator structure, an annular sealing element (218) can be placed against the annular ledge (216). When the concealed aerator (200) is screwed into the spout end, the annular sealing element (218) presses against an annular transverse surface (220) which is formed as discussed with reference to FIG. 1, where the female threaded pipe portion (202) meets the upstream pipe portion (204) which is of smaller diameter. In this regard, it should be noted that the inner diameter of the upper pipe portion (204) is maximized. That is, although less than the inner diameter of the female threaded pipe portion (202), the inner diameter of the upstream pipe portion (204) is made as large as possible, provided that the annular sealing element such as a resilient washer (218) fits between the spout (200) and aerator (208). Generally, said pipe portion (204) is on the order of 17.5 mm and the concealed aerator (208) may have only two rows of chambers and a smaller screen outlet diameter without impairing aeration. In most U.S. states a flow rate as low as 2.5 GPM at 80 lbs. back pressure is recommended and in California it is compulsory. The above-mentioned dimensions achieve the recommended or compulsory flow characteristics.

Referring again to the structure of the aerator (208) shown in FIG. 2, the liquid inlet element (206) is shown having a jet forming means (230) over which is placed a perforated disc (232). The perforated disc (232) restricts the inflow of liquid to the concealed aerator (208), while the jet forming means (230) forms the inflow of water thereto into a plurality of streamlets. Below the jet forming means (230) is a shell (234) which contains a screen (236) through which the streamlets from the jet forming means (230) pass. Examining the shell (234) which contains the screen (236), it is noted that the screen-and-shell assembly is movable vertically within the interior of the concealed aerator (208). Specifically, when a coin (238) is inserted into indents (240) at the downstream end of the concealed aerator (208), the shell-and-screen assembly is forced upstream. That is, normally the shell (234) which contains the screen (236) rests at the downstream end of the concealed aerator (208) as suggested by the dashed representation of the shell indicated by the numeral (242). Insertion of the coin (238) causes the shell (234) to travel vertically upstream as shown by the solid representation of the shell (234). Accordingly, it is noted that there is a cavity in the interior of the aerator (208). This cavity is formed by the substantially cylindrical inner wall (246) of the tubular element (210) and a plurality of vertical ribs (248) which are spaced at various angular positions around the inner periphery of the wall (246). At the downstream end of the ribs (248) are prongs (250) which, as seen in FIG. 2, confine the downstream travel of the shell (234). Specifically, the shell (234) is dimensioned to abut the prongs (250) when in its downstream normal position (242). The water from chambers 902 is directed into the air-mixing space that is above screens 236. Air enters between vertical ribs 248 and passes to said air-water mixing space.

Figure 3:
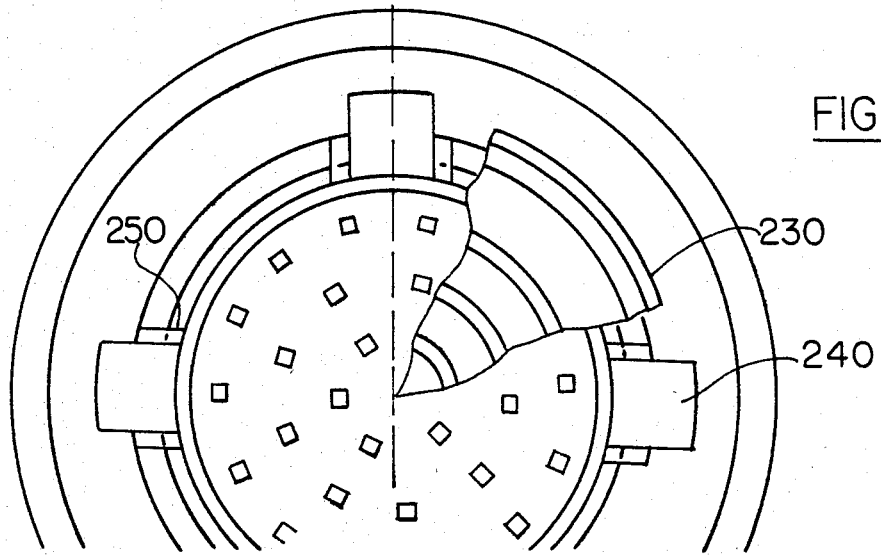
FIG. 3 is a part-cutaway bottom view of the aerator shown in FIG. 2 taken along line 3—3.

Referring to FIG. 3, the prongs (250) are shown from a bottom view and the indents (240) into which the coin (238) is inserted are shown in cutaway. It is, of course, recognized that the indents (240) are preferably at diametrically opposite points at the lower portion of the concealed aerator (208). In addition, there may be several pairs of such indents into which a coin (238) may be inserted. The cutaway portion, it is noted, shows the jet forming means (230) in partial view.

Figure 4:
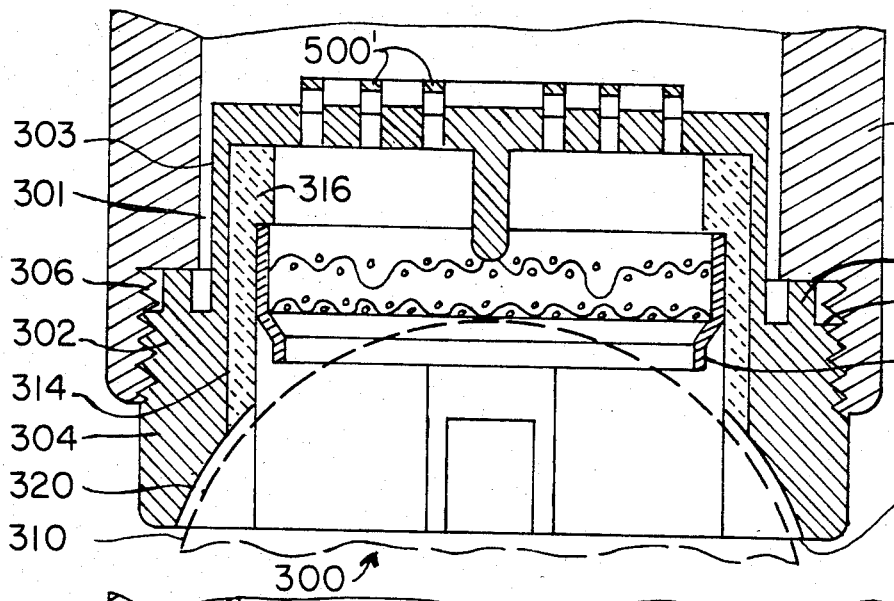
FIG. 4 is an illustration of a partially concealed aerator.

Referring now to FIG. 4, a partially concealed aerator (300) is shown. Specifically, the aerator (300) includes a tubular element (301) which includes a first tubular length (302), a second tubular length (303) and a third tubular length (304). The partially concealed aerator (300), like the aerators in FIGS. 1 and 2, is structured to fit into a spout (305) having a downstream pipe portion (306), which is threaded with standard female threading and an upstream pipe portion (307) which has an orifice of diameter less than that of the female threaded portion (306) but, nonetheless, maximized to the greatest extent possible. The first tubular element (302) is shown having standard male threading (such as the 23.5 mm diameter previously noted). Extending upstream from the first tubular length (302) is the second tubular length (303) which is unthreaded and has a diameter which is less than the outer diameter of the first tubular length (302). Extending downward from the first tubular length (302) is the third tubular length (304) which is shown to have an outer and inner diameter preferably greater than that of the second tubular length (303).

As in the FIG. 2 embodiment, the aerator (300) of FIG. 4 can be inserted by screwing the aerator (300) into the spout by using a coin (310). In the FIG. 4 embodiment, a screen-containing shell (312) is forcefit into the interior of the aerator (300) at an upstream position. It is seen that the inner wall (314) of the tubular portion (301) has coupled thereto radial ribs (316) to which the screen-containing shell (312) can be fixedly coupled. It is noted that the shell (312) is recessed sufficiently from the downstream end of the partially concealed aerator (300) to permit the insertion of the coin (310). As previously noted, the coin (310) is inserted into indents (320) provided at preferably diametrically opposite positions at the downstream end of the partially concealed aerator (300). In FIG. 4, it is noted that the annular washer (318) shown in FIG. 2 is replaced by an annular ridge (322) extending upward from the annular ledge (324) which interfaces and extends between the threading of the first tubular length (302) and the outer surface of the second tubular length (303).

The embodiment shown in FIG. 4 is a longer aerator than that shown in FIG. 2. This embodiment is used when the spout (305) is not enough above the threaded portion (306) to accomodate an aerator such as that shown in FIG. 2. In the FIG. 4 embodiment the second tubular length (303) can have an outer diameter of approximately 20 mm, to fit within a spout (305) which is correspondingly dimensioned.

Figure 5:
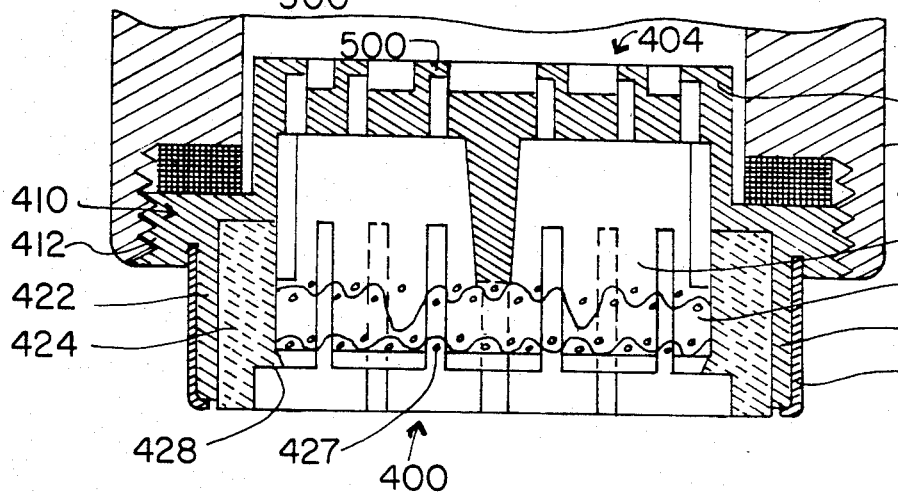
FIG. 5 is an illustration of another partially concealed aerator.

Referring now to FIG. 5, a partially concealed aerator (400) is illustrated in which the upstream pipe portion (402) of spout (403) is not maximized. That is, the spout (403) has the same dimension as that shown in FIG. 1, which is conventionally provided.

As in FIG. 4, a tubular element (410) in the FIG. 5 embodiment includes a first length (412), a second length (416) and a third length (418), the first length (412) having standard male threading and being interposed between the unthreaded second tubular length (416) which is upstream therefrom and the unthreaded third tubular length (418) which is downstream therefrom. The third tubular length (418), if desired, can be encased or housed in a metal sleeve (420). Along the inner wall (422) of the tubular length (410) are a plurality of radial ribs (424). Contained within the ribs are longitudinally extending curtains (426) having vertical slits (427) therebetween. The curtains (426) encircle the screen (406), air entering the slits (427) between the curtains (426) to provide aeration of the liquid passing through the screen (406). The screen (406) is held in place by prongs (428) which project inwardly from the ribs (424) at the downstream end thereof. The slits (427) are large enough to permit air to flow in but not sufficiently large that water flows out therefrom. As an alternative to the prongs (428) the screen (406) may be coupled in place by ultrasonic treatment or other means.

Figure 6:
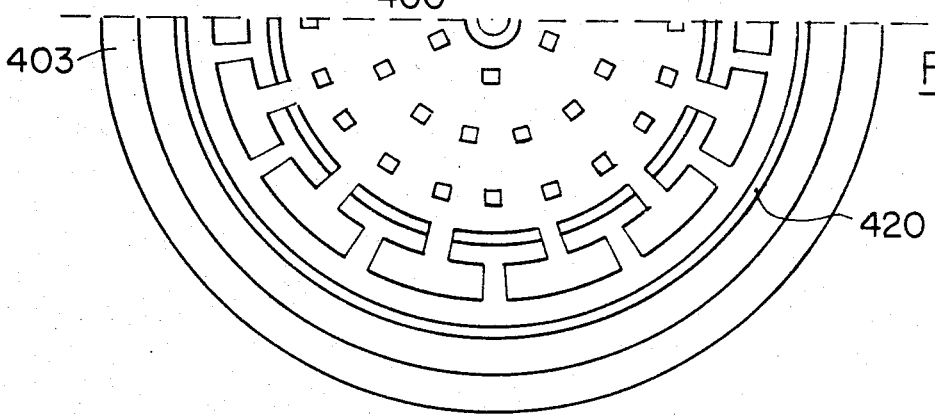
FIG. 6 is a partial bottom view of the aerator illustrated in FIG. 5.

FIG. 6, a bottom view of FIG. 5 (with screen 406 removed), shows the spout (403), the metal encasing (420) of the third tubular length (418), a plurality of the longitudinal ribs (424) as well as the curtains (426), and the prongs (428).

Examining the jet forming means (404), it is noted that a plurality of bridge elements (500) are provided. (Bridge elements (500') are also provided in the FIG. 2 and FIG. 4 embodiments.) The bridge elements (500) may have various configurations as suggested by the embodiments disclosed above. The square outputs 501*a* of chambers 501 are shown in FIG. 6.

It should also be noted that, in FIG. 5, liquid flows into the jet forming means (404) from one side of each bridge (500). In FIGS. 2 and 4, an alternative embodiment is shown wherein liquid flows in from both sides of the bridge element (500').

The aerator of FIG. 5 may be modified to decrease its cost. The tubular length 418 and ribs 424 may be eliminated and the metal shell 420 may have a smaller diameter around the curtains 426 resulting in less expense. The shell 420 would be placed short of the uppermost portion of the curtains 426 to permit the inflow of air. In such a case, the prongs 428 are done away with and curtains 426 are shortened so that screen element 406 of large diameter may be held directly by the metal shell 420, the shell 420 having a ledge for that purpose at its lower end. In such a modified embodiment of FIG. 5, the uppermost portions of slits 427 remain uncovered by the metal shell 420. These portions would be concealed by the first length 412.

Figure 7:
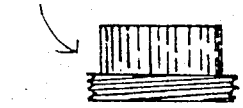
FIGS. 7 through 9 are illustrations showing the outer shape of a totally concealed aerator and two partially concealed aerators respectively.
Figure 8:
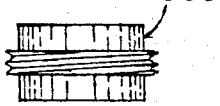
Figure 9:
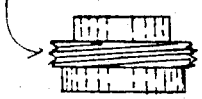

Referring to FIGS. 7, 8 and 9, it is noted that FIG. 7 shows a simplified structure of a completely concealable aerator (600) as shown in FIG. 2. FIG. 9 illustrates a partially concealed aerator (605) such as that shown in FIG. 5. It should be noted that FIG. 8 shows an alternative embodiment in which the second tubular length (606) of the embodiment shown in FIG. 2 may be of a diameter and height small enough for original insertion in spouts being made as well as serve for replacement of old aerators in use.

As previously indicated the dimensions of the invention in the various embodiments are significant. In the FIG. 2 embodiment, in particular, the aerator (208) has the following preferable dimensions. The inner wall (246) preferably has an inner diameter of 19 mm, while the inner diameter of the vertical ribs (248) are 17.25 mm. The outer diameter of the shell (234) is preferably 17 mm, the thickness of the shell (234) being 0.2 mm. The jet forming means (230) has two rows of channels (902) at center-to-center distances of 4 mm and 14 mm including 14 channels (702) in the outer row and 4 channels in the inner row. Entrance openings (900) to each channel (902) has a cross-section of 0.5 mm×0.5 mm whereas the cross-section of each channel (902) is a constant 1 mm×1 mm having, as previously noted, a length of 3.5 mm. The screen (236) has 40 wires per inch, each wire having a diameter of 0.01 inches. Preferably the screen (236) includes 2 layers separated from each other by 1 mm. With the above indicated dimensions, the totally concealed aerator (208) of FIG. 2 provides a rate of flow of 2.6 gallons per minute at 80 pounds back pressure, which conforms with the water saving regulations of various states in the United States. Similarly, the embodiments shown in FIGS. 4 and 5 also conform to the appropriate state regulations standards when properly dimensioned. In the aerator of FIG. 5 for instance, the jet-forming means (404) may have two rows of chambers aligned at center to center distances of 11.0 mm and 6.0 mm, so that the jets issuing therefrom will shoot at a safe distance from slits (427) and maintain free inflow of air therethrough. In such a disc (404) a total of 16 chambers were provided, each of which had a cross section of 1.0×1.0 mm. These chambers were topped each by a bridge open on both sides, each entrance opening so formed being 0.6×0.6 mm. Thus, an aerator of this invention, whether partially or entirely concealed, may embody such a disc, have a second tubular length of a diameter less than 17.00 mm and fit new as well as existing spouts.

In FIGS. 10, 11, 12, and 13, a screen-holding tubular member 701 has a knurled skirt 702 which extends below the downstream end of the spout 720. Member 701 and skirt 702 may be chromium plated or made of plastic so treated as to appear metallic, if desired.

Figure 11:
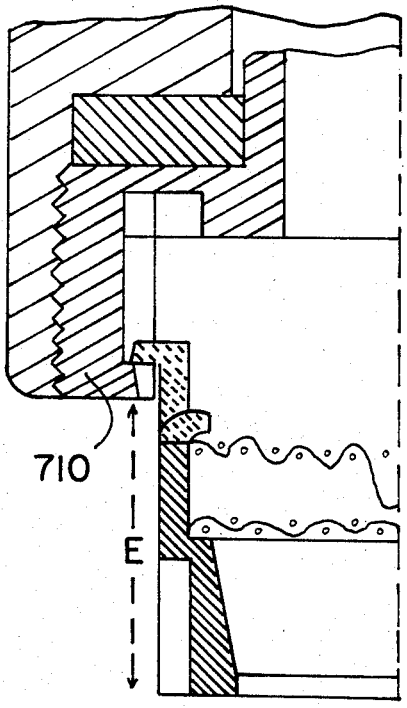

The skirt 702, upon easy rotation of a few degrees will fall down to the position shown in FIG. 11. The resulting 7 to 8 mm. long tubular extension E below the end of the spout facilitates installing or removing the aerator 700. That is, after the screen holder 701 moves downward, to the FIG. 11 position, a further rotation of the skirt 702 results in the unscrewing of the aerator 700. This screw or unscrewing can be done by using a tool, such as pliars.

In the totally concealed aerator now in limited use, some people do not know how to remove it while others do not even realize there is an aerator inside the spout. These aerators are not threaded with the standard male threads having an outside diameter of 23.5 mm. and said threads are not located near or at the downstream end of the aerator.

Figure 10:
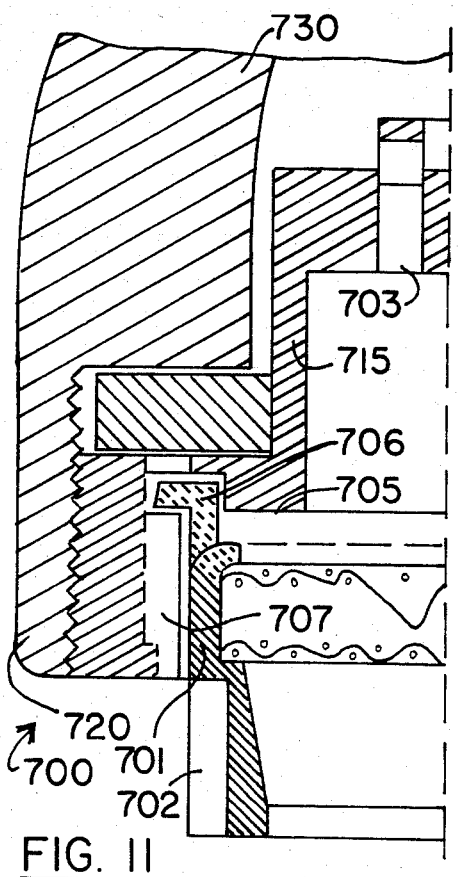
FIGS. 10–13 are illustrations of an alternative embodiment of the present invention.
Figure 12:
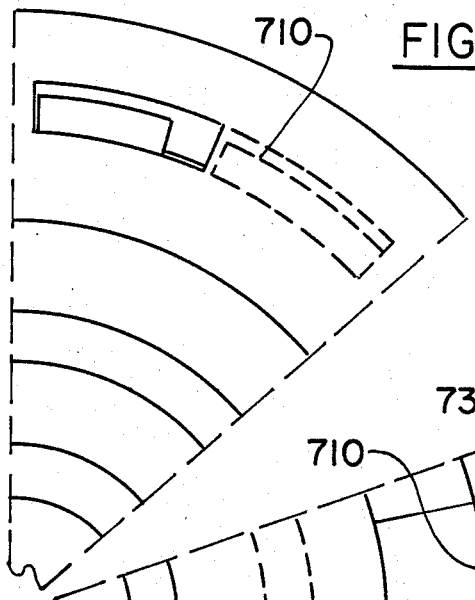
Figure 13:
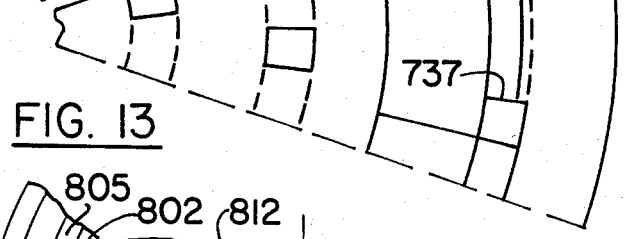

As shown in FIG. 10, the aerator 700 has jet-forming orifices 703. The screen holder 701 has three or four legs 705, each leg 705 projecting outwardly into a tongue 706 which rests on top of a rib 707. When the screen holder 701 is rotated, the tongue 706 disengages the rib 707 and falls onto ledge 710, as shown in FIGS. 11 and 12. FIG. 12 illustrates the top view of the aerator in the absence of washer 715, whereas, FIG. 13 shows its bottom view in the absence of the screen holder 701. When the screen holder 701 is rotated anti-clockwise, the tongue 706 falls on ledge 710 and if it is further rotated anti-clockwise, the aerator 730 will unscrew as noted above. The aerator removal is achieved when twisting results in the tongue 706 pushing against a wall 732 on the aerator 700. During the insertion of the aerator into the spout the screen holder 701 is rotated clockwise and tongue 706 pushes on wall 737.

Figure 15:
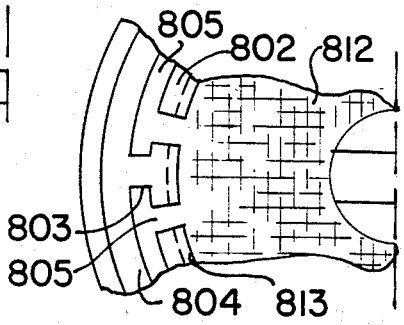
FIG. 15 is a bottom view of FIG. 14 with screens removed.
Figure 14:
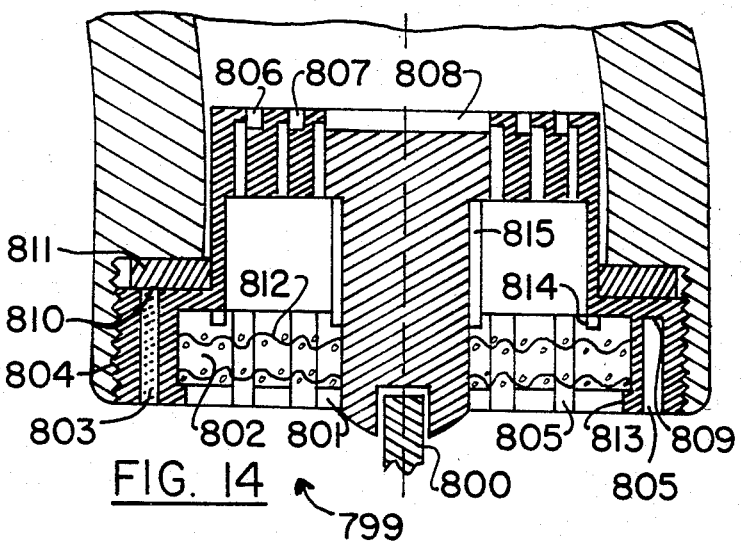
FIG. 14 is an illustration of an other alternative embodiment of the present invention.

FIG. 14 is a concealed aerator 799 which is inserted in and screwed on to the spout by means of a coin 800. One important feature of this aerator 799 is its small diameter upstream its male threads, so that it will enter within most standard female threaded spouts while its much larger downstream portion provides all the space needed for locating therein a large diameter screen element and providing air passageways as large as in conventional aerators. Another important feature is the provision of a stem 801 having an indent within which a coin 800, such as a quarter may be inserted for installing or removing the aerator 799 from the spout. The screen holding member is still another important feature of this aerator. The screen holding member comprises curtains 802 all of which, or only some of which as shown in FIG. 15, may be connected with webs 803 to the threaded annular member 804, an air passageway is shown as 805.

In this aerator 799, the tubular portion upstream the threads may be only 16 mm. in diameter or smaller. Thus, in the United States where low rate of flow is required, only two rows of jet-forming orifices of the type shown in FIG. 10 by 703 may be used, permitting the decrease of the overall diameter of the aerator 799 upstream the threaded portion to a diameter of even less than 16 mm.

The greater rate of flow of the European aerator may require three rows of jet-forming orifices 806, 807, and 808. In such a case, the diameter may be increased to 16 mm. to permit insertion of the aerator into most female standard threaded spouts.

It will be noted that the air passageways 805 may be closed at 809 as shown, or open as shown at 810, according to molding requirements. When they are closed, webs 803 may be done away with, if desired. In the latter case, the sealing is effected by washer 811.

The screen 812 is held in position by lips 813, prongs 814 and ribs 815, which help keep them in position.

Fully bubble-saturated stream were produced when the jet-forming disc comprised two rows of chambers at 6 and 12 mm. Center-to-center distances wherein the chamber were 2 mm. high and had a cross section of $1.0\times1.0$ mm., and each entrance opening upstream the chambers measured $0.6\times0.6$ mm. The number of the resulting water passageways being such as to deliver 2.5 GPM at 80 LBS back pressure, in compliance with the California regulations.

An equally bubble-saturated stream was produced from aerators designed to meet the European flow decibel requirements, where center-to-center distances of the chamber were 7, 10, 14 mm. with about 48 chambers having each a cross section of $0.6\times0.6$ mm. and a single entrance opening of $0.6\times0.7$ mm.

Furthermore, it should be noted that the present invention is easily fabricated and assembled, wherein the first, second and third tubular length of the tubular elements disclosed above, or any combination thereof, may be integrally formed as a molded plastic unit. In addition, the jet forming means may also be integrally formed with the various tubular lengths. This, of course, renders the fabrication of the aerator simpler. Also the insertion of the aerator into a spout is simpler where the number of parts is greatly reduced. In addition, it is noted that the molded plastic may include metal if desired.

Referring again to FIG. 5, it is noted that the aerator (400) may be concealed almost entirely by extending the second tubular length (416) further upstream into the spout (403). The screen (406), curtains (426) and slits (427) therein may then be positioned further upstream. The portion of the aerator (400) below the prongs (428) and the ribs (424) may then be eliminated. At still another option, the inner and outer diameter of the third tubular length (418) may be increased to the characteristic diameters of the threaded first tubular length (412). In this embodiment, the area enclosed by the curtains (426) may thus be enlarged and may, thereby, house a screen (406) of larger diameter. This increase in diameter would increase the cross-section of the stream exitting the aerator (400) as desired. Still further, although specific jet forming means (404) is shown, various conventional elements may be substituted therefor.

Other improvements, modifications and embodiments will become apparent to one of ordinary skill in the art upon review of this disclosure. Such improvements, modifications and embodiments are considered to be within the scope of this invention as defined by the following claims.

I claim:

1. An improved aerator for insertion into a spout through which water flows, the spout having (a) a downstream pipe portion with female threading along the inner surface thereof, the smallest diameter of the female threading being $d_1$; (b) an upstream pipe portion which (i) has a common longitudinal axis with and is axially adjacent to the downstream pipe portion and (ii) has an inner diameter $d_2$ which is less than $d_1$; and (c) an annular surface extending between the inner surface of the upstream pipe portion and the inner surface of the downstream pipe portion, the improved aerator comprising:

a tubular element including (a) a first tubular length having standard male threading therearound which is complementary with the female threading along the inner surface of the downstream pipe portion of the spout, the diameter of the threaded first length being substantially equal to $d_1$; (b) an unthreaded second tubular length which shares a common longitudinal axis with and is axially adjacent to the first length of the tubular element and has an outer diameter $d_3$ which is less than $d_2$; and (c) an annular ledge extending between the outer wall of the second length and the outer wall of the first length;

an annular sealing element;

jet forming means for forming the flow of water into jets, the jet forming means being encircled by the tubular element;

wherein the second length of the tubular element fits within the upstream portion of the spout when the first length of the tubular element is screwed into the downstream portion of the spout;

wherein the annular sealing element comprises a sealing interface between the annular ledge of the tubular element and the annular surface of the spout when the aerator is screwed into the spout; and wherein the aerator is at least partially concealed when the aerator is screwed into the spout.

2. An improved aerator according to claim 1 wherein the annular sealing element comprises an annular washer.

3. An improved aerator according to claim 1 wherein the annular sealing element comprises an annular resilient washer, the annular resilient washer being compressible against the annular surface of the spout to form a liquid tight seal.

4. An improved aerator according to claim 1 wherein the tubular element including the male threading thereon is molded plastic, a watertight seal being formed by the male threading and the female threading when the aerator is screwed into the spout.

5. An improved aerator according to claim 1 wherein the male threading on the first length extends to the downstream end of the aerator and wherein the downstream end of the aerator does not extend longitudinally beyond the end of the spout when the aerator is inserted, thereby providing substantially total concealment of the aerator.

6. An improved aerator according to claim 5 wherein the first tubular length has at least one pair of indents in the inner wall of the tubular element, the indents of each pair positioned and dimensioned to accomodate the insertion of a coin therein, the aerator being coupled to the spout in response to rotation of the inserted coin in a first direction and the aerator being decoupled from the spout in response to rotation of the coin in a second opposite direction.

7. An improved aerator according to claim 1 wherein the tubular element further comprises:

an unthreaded third tubular length, the first tubular length being disposed between the second tubular length and the third tubular length, wherein (a) the first tubular length and the second tubular length are surrounded by the spout and (b) the third tubular length extends downward beyond the end of the spout when the aerator is inserted into the spout.

8. An improved aerator according to claim 7 wherein the third tubular length has an inner diameter which exceeds the inner diameter of the second tubular length.

9. An improved aerator according to claim 7 wherein the first, second, and third tubular lengths each comprise molded plastic and the aerator further comprises:

a metal casing housing the third tubular length.

10. An improved aerator according to claim 1 wherein the first length and second length of the tubular element are molded plastic.

11. An improved aerator according to claim 10 wherein the jet forming means is integrally coupled to the second tubular length; and wherein the first tubular length, the second tubular length and the jet forming means are molded in plastic as an integral unit.

12. An improved aerator according to claim 11 wherein the aerator further includes a perforated disc upstream from the jet forming means and coupled to the upstream edge of the second tubular length, the disc restricting the flow entering the jet forming means.

13. An improved aerator according to claim 11 wherein the jet forming means further comprises a plurality of bridge elements, each bridge element being positioned upstream from a respective elongated channel, each bridge element defining at least one inlet for water entering the respective channel.

14. An improved aerator according to claim 13 wherein the molded plastic contains metallic particles.

15. An improved aerator according to claim 10 wherein the molded plastic contains metallic particles.

16. An improved aerator according to claim 1 wherein the tubular element has an inner cylindrical wall of diameter $d_5$; wherein the aerator further comprises a cylindrical shell of outer diameter $d_6$ and a screen contained within the shell; wherein the tubular element further comprises a plurality of vertical disposed ribs which (a) jut inwardly from and (b) are located at angular positions about the inner wall of the tubular element, the distance between diametrically opposite ribs being $d_7$ where (a) $d_7$ is less than $d_6$ and (b) the inner wall with the ribs jutting inward therefrom define a longitudinal cavity in which the shell is contained and along which the shell moves; and wherein the aerator further comprises;

means for confining the shell to a prescribed distance of movement along the cavity.

17. An improved aerator according to claim 16 wherein the confining means comprises a prong at the downstream end of each of a plurality of the ribs, each prong projecting inwardly, the prongs being dimensioned and positioned to limit movement of the shell to positions upstream from the prongs.

18. An improved aerator according to claim 16 wherein the first tubular length has at least one pair of indents in the inner wall of the tubular element, the indents of each pair positioned and dimensioned to accomodate the insertion of a coin therein, the aerator being coupled to the spout in response to rotation of the inserted coin in a first direction and the aerator being decoupled from the spout in response to rotation of the coin in a second opposite direction.

19. An improved aerator according to claim 18 wherein the cavity defined by the inner wall with the ribs jutting inwardly, is dimensioned such that the shell can move sufficiently upstream to permit insertion of the coin into the slits in the first tubular portion.

20. An improved aerator according to claim 1 wherein the tubular element has an inner cylindrical wall of diameter $d_5$;

wherein the aerator further comprises:

a plurality of curtains disposed in a cylindrical pattern, the curtains having spaces forming slits therebetween; and a screen encircled by the curtains;

wherein the tubular element further comprises:

a plurality of longitudinally disposed ribs which (a) jut inwardly from and (b) are located at angular positions about the inner wall of the tubular element, the diameter of the outer wall of said curtains being smaller than the diameter $d_5$; and means for holding the screen in fixed position encircled by the curtains;

the slits providing passageways for air which aerates the water when such water flows through the screen.

21. An improved aerator according to claim 1 wherein the inner diameter $d_2$ of the upstream pipe portion of the spout is smaller than 20.75 mm and wherein the outer diameter $d_3$ of the second tubular length ranges between 14 mm and 20.50 mm.

22. The aerator in claim 1 further comprising a screen element (a) located downstream from the jet-forming means and (b) encircled by the first tubular length of the tubular element;

the screen element being enough to produce a bubble-laden stream;

the jet-forming means including a stem projecting axially through the screen element, the downstreammost portion of the stem having an indent therein into which a coin is insertable, the twisting of the coin in either direction being used to selectively install or remove the aerator.

23. The aerator in claim 22 further comprising:

a plurality of spaced apart curtains positioned at angular intervals, the curtains being positioned inward from the inner wall of the first tubular length, the curtains being positioned and dimensioned to hold the screen element;

the spacing between curtains extending upstream of the screen element providing a passageway for aerating water entering the screen element.

24. The aerator in claim 23 wherein at least some of the curtains are connected to the inner wall of the first tubular length.

25. The aerator in claim 1 further comprising:

a screen of circular cross-section of diameter $d_9$ where $d_2 < d_9 < d_1$; and means for positioning the screen to be encircled by the first tubular length downstream from the jet-forming means.

26. An aerator as in claim 1, wherein said male threading has a diameter of 23.5 mm.

27. An aerator as in claim 1, further comprising:

a screen element downstream from the jet-forming means; and a metallic cylindrical shell (a) extending downstream from the first tubular length and (b) encircling the screen element, the metallic shell having an inwardly projecting ledge upon which the screen element sits.

28. An aerator as in claim 27, further comprising:

a cylindrical member between the metallic shell and the screen element, the cylindrical member comprising a plurality of angularly spaced curtains with longitudinally extending slits therebetween;

the upstreammost portion of the slits extending beyond the upstreammost portion of the metallic shell to permit air to flow along the slits upstream of the screen element.

29. An improved aerator and spout combination, wherein the spout comprises:

a downstream pipe portion with female threading along the inner surface thereof, the smallest diameter of the female threading being $d_1$;

an upstream pipe portion which (i) has a common longitudinal axis with and is axially adjacent to the downstream pipe portion and (ii) has an inner diameter $d_2$ which is less than $d_1$; and an annular surface extending between the inner surface of the upstream pipe portion and the inner surface of the downstream pipe portion; and wherein the aerator comprises:

a tubular element including (a) a first tubular length having standard male threading therearound which is complementary with the female threading along the inner surface of the downstream pipe portion of the spout, the smallest diameter of the threaded first length being substantially equal to $d_1$; (b) an unthreaded second tubular length which shares a common longitudinal axis with and is axially adjacent to the first length of the tubular element and has an outer diameter $d_3$ which is less than $d_2$; and (c) an annular ledge extending between the outer wall of the second length and the outer wall of the first length;

an annular sealing element disposed between the annular ledge of the tubular element and the annular surface of the spout; and means for introducing air into a flow of liquid entering the aerator from the spout, the introducing means being encircled by the tubular element;

wherein the second length of the tubular element fits within the upstream portion of the spout when the first length of the tubular element is screwed into the downstream portion of the spout;

wherein the annular sealing element comprises a sealing interface between the annular ledge of the tubular element and the annular surface of the spout; and wherein the aerator is at least partially concealed in the spout.

30. An improved aerator according to claim 29 wherein the inner diameter of the first tubular length is greater than the inner diameter of the second tubular length.

31. An aerator for insertion into a faucet of the type having a spout that has (1) a downstream end, (2) a limited first portion of said spout, extending upstreamwardly from said downstream end, (3) a second portion upstream of said first portion, said first portion being of larger inside diameter than said second portion, (4) female threads on said first portion, and (5) inside wall means connecting said first and second portions, said aerator comprising:

a body member having a centerline extending in the general direction of the flow of water through the aerator, a transverse upstream disk portion, and a side wall, said side wall including a flange extending away from said side wall transverse to the general direction of water flow through the aerator, said flange having a periphery with male threads complementary to the female threads on the spout, said flange having an upstream portion, sealing means on said upstream portion of said flange for engaging said inside wall means to seal the aerator against water flow through the spout passing around said flange, said disk portion being upstream of said flange and defining at least one orifice for directing at least one jet of water in a downstream direction, and mixing means downstream of said disk portion for mixing the water of said jet with air and discharging an aerated jet of water, said body member defining (1) a mixing space between said disk portion and said mixing means and, (2) an air passageway extending upstreamwardly within the body member to said mixing space.

32. An aerator as defined in claim 31 in which said body member includes a ledge, said mixing means normally resting on said ledge and being free to move upstreamwardly.

33. An aerator as defined in claim 32 in which said body member has a downstream end defining a slot transverse to said center line, in its downstream end, and for receiving a flat member, said slot being sufficiently deep so that the insertion of a flat member in said slot will move said mixing means upstreamwardly from its normal position on said ledge.

34. An aerator as defined in claim 33 in which said male threads are adjacent said downstream end of said body member so that, when said aerator is screwed into said spout, at least substantially the entire aerator is within said spout.

35. In a faucet with a spout having a downstream end, said spout also having (1) a limited first portion extending upstreamwardly from said downstream end, said portion having an inner wall, (2) a second portion upstream of said first portion, said second portion having a smaller inside diameter than the inside diameter of said first portion, (3) female threads on the inner wall of said first portion, and (4) inside wall means connecting said first and second portions, a body member in the shape of an inverted cup, said body member having a center line extending in the general direction of the flow of water through the aerator, a transverse upstream disk portion, and a tubular side wall, said side wall including a flange extending away from said side wall transverse to the general direction of water flow through the aerator, said flange having a periphery with male threads complementary to the female threads on the spout, said flange having an upstream portion.

sealing means on said upstream portion of said flange for engaging said inside wall means to seal the aerator against water flow through the spout passing around said flange, said disk portion being upstream of said flange and defining at least one orifice for directing at least one jet of water in a downstream direction, and mixing means downstream of said disk portion for mixing the water of said jet with air and discharging an aerated jet of water, said body member defining, (1) a mixing space between said disk portion and said mixing means and (2) an air passageway extending upstreamwardly within the body member to said mixing space.

36. In a faucet as defined in claim 35 in which said body member defines a ledge, said mixing means normally resting on said ledge and being free to move upstreamwardly.

37. In a faucet as defined in claim 36 in which said body member has a downstream end and defines a slot in its downstream end, for receiving a flat member, said slot being in a plane transverse to said center line, said slot being sufficiently deep so that the insertion of a flat member in said slot will move said mixing means upstreamwardly from its normal position on said ledge.

38. In a faucet as defined in claim 37 in which said male threads are adjacent said downstream end of said body member so that, when said body member is screwed into said spout, at least substantially the entire body member is within said spout.

* * * * *